United States Patent [19]

Putzier et al.

[11] 3,955,965

[45] May 11, 1976

[54] REFINING METALS

[75] Inventors: Udo Putzier, Neubeckum; Dietrich Radke; Heinrich-Otto Rossner, both of Essen, all of Germany

[73] Assignee: Fried, Krupp Gesellschaft mit beschrankter Haftung, Essen, Germany

[22] Filed: Apr. 4, 1974

[21] Appl. No.: 458,032

[30] Foreign Application Priority Data

Apr. 4, 1973 Germany ..... 2316768

[52] U.S. Cl. ..... 75/52; 75/60

[51] Int. Cl.[2] ..... C21C 7/06

[58] Field of Search ..... 75/52, 51, 60, 56

[56] References Cited

UNITED STATES PATENTS

| | | | |
|---|---|---|---|
| 3,323,907 | 6/1967 | Kurzinski | 75/60 |
| 3,330,645 | 7/1967 | DeMoustier | 75/60 |
| 3,706,549 | 12/1972 | Knuppel | 75/60 |
| 3,771,998 | 11/1973 | Knuppel | 75/52 |

FOREIGN PATENTS OR APPLICATIONS

| | | | |
|---|---|---|---|
| 1,450,718 | 7/1966 | France | 75/60 |

*Primary Examiner*—Peter D. Rosenberg
*Attorney, Agent, or Firm*—Spencer & Kaye

[57] ABSTRACT

The present invention relates to a) a method for refining metal in which, e.g., oxygen and fine lime are introduced through at least one nozzle disposed below a molten bath surface in the refining vessel and a gas is fed in through one or a plurality of further nozzles associated with each first nozzle and to b) an apparatus for practicing the method.

15 Claims, 1 Drawing Figure

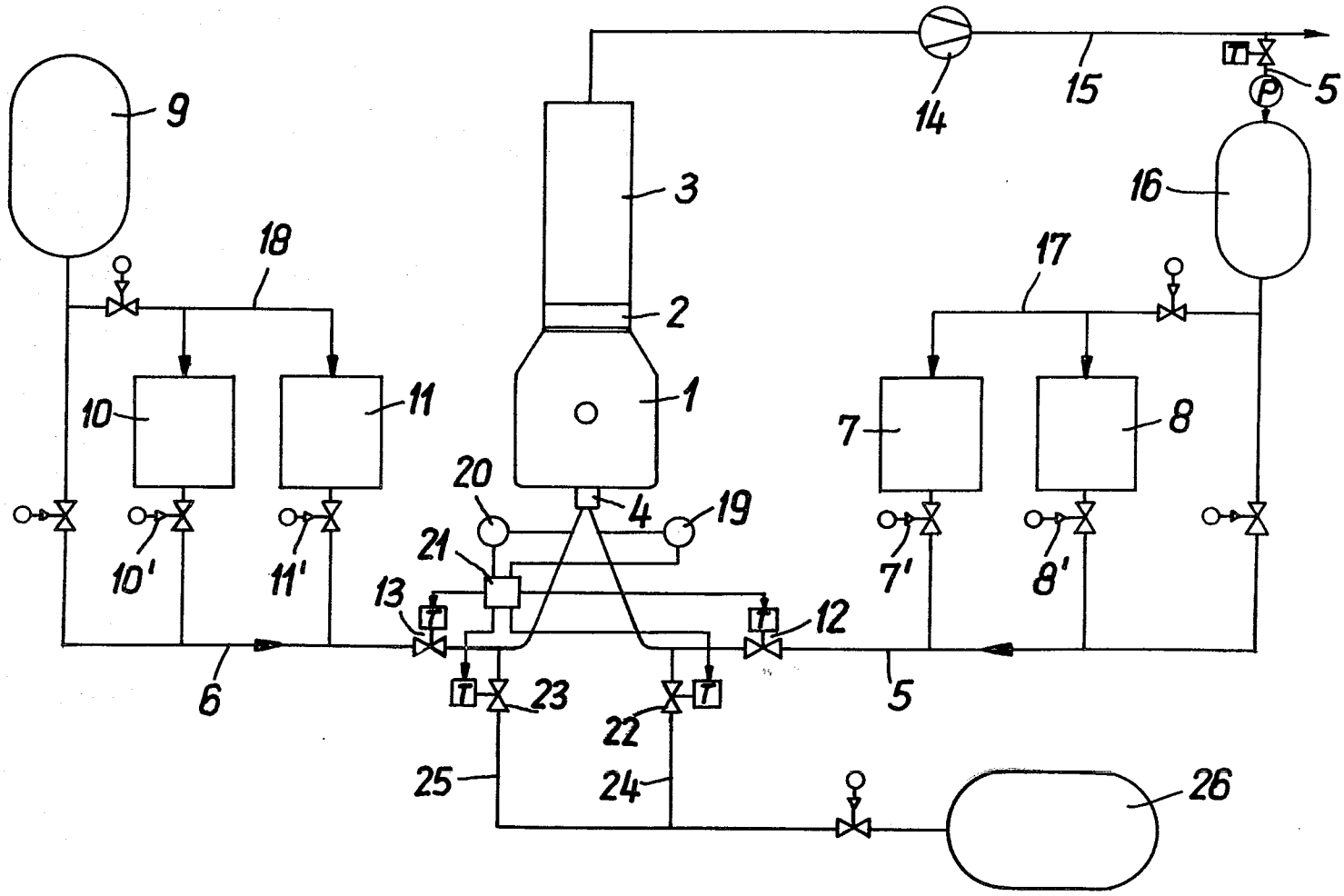
1
2
3
4
5
6
7
7'
8
8'
9
10
10'
11
11'
12
13
14
15
16
17
18
19
20
21
22
23
24
25
26

REFINING METALS

BACKGROUND OF THE INVENTION

Gaseous hydrocarbons, particularly propane, are used as coolant to protect nozzles for and bottoms of vessels used in processes, such as those employed for refining pig iron. Liquid hydrocarbons are alternatively added through jackets of jacketed nozzles through which oxygen is introduced into the melt.

Thus introduced hydrocarbons, which are blown into molten metal (in addition to oxygen) have a cooling effect because of their thermal decomposition, and they serve as protection for the nozzles and the floor or base of the refining vessel, e.g. converter.

In such processes a major portion of hydrogen (produced by hydrocarbon decomposition) passes through the metal bath almost completely uncombusted, so that little heat is developed from the added amount of hydrocarbon; moreover, the hydrocarbon decomposition is endothermal. In addition, the liquid steel absorbs hydrogen which must be subsequently removed by a costly cleaning process, for example by rinsing with suitable gas.

When partially or completely uncombusted waste gas is extracted to permit purification of the waste gas and thus keep the cost low, a further serious drawback results; the hydrogen content of the waste gas increases the danger of explosion in the waste gas system when it exceeds certain limits. For this reason, enlargement of the hydrocarbon stream, for example for the purpose of turning over larger quantities of scrap metal, is narrowly confined.

A method for air refining with pure oxygen (German Patent No. 763,185) provides introduction into a converter of gaseous, liquid or, preferably, solid additives, such as carbon dust, by means of separately introduced compressed air by blowing these materials through nozzles in the bottom usually employed in bottom blowing converters. This process cannot be used for blowing with more or less pure oxygen because the carbon would be ignited shortly before it leaves the nozzles and the firing points in the nozzle would move downwardly, thus destroying the nozzle bottom.

SUMMARY OF THE INVENTION

Oxygen and finely divided solids, e.g. fine lime, are introduced through at least one first nozzle disposed below the surface of a molten metal bath in a refining vessel, and a gas is introduced through one or a plurality of further nozzles associated with the first nozzle, the gas being a carrier gas which does not react with carbon and which is used to introduce solid carbon or solid carbonaceous materials of a finely divided state, and therefore herein also descriped as carbon dust.

One aspect of the invention is directed to apparatus for practicing such a method.

An object of the invention is to avoid drawbacks of known metal-refining processes. A further object is to make possible variation of the ratio of solid materials to liquid materials within wide limits.

Another object is to avoid requiring carrier gas to cool nozzles or the bottom of the refining vessel; the amount of carrier gas, therefore, need not exceed that absolutely required for transporting the finely divided carbon dust.

These and additional objects are achieved by the subject method and apparatus.

BRIEF DESCRIPTION OF THE DRAWING

The sole FIGURE provides a schematic representation of the apparatus.

DETAILED DESCRIPTION OF THE INVENTION

As is readily appreciated from the following description, the process and apparatus are applicable for refining numerous metals. Particular advantages inure from applying this invention to the refining of, e.g., pig iron.

One embodiment provides for enveloping a stream of oxygen with carbon or carbonaceous material in dust form and as a sheath; finely divided carbon dust is thus introduced as the carbon in a carrier gas. Most inert gases are suitable carrier gases. It is particularly advantageous, however, to employ carbon monoxide and to obtain this carbon monoxide from the refining process itself. When a sealed waste gas system is used, the required carbon monoxide can be recirculated. To do this, a small portion, e.g., from 0.3 to 2 percent by volume, of the waste gas, which contains up to 98% CO, is diverted with conventional dust-removing apparatus. The metal can be maintained in the normal temperature range of 1200°C up to 1650°C during refining.

It is advantageous to blow in from 3 to 30 liters (l) of carrier gas per kilogram (kg) of solid matter, preferably from 4 to 12 l/kg. The carbon is primarily that which is particularly reactive with respect to oxygen. As carbonaceous material for this process it is possible to use all types of pulverized coal, e.g., brown coal, hard coal, high-volatile coal as well as of pulverized coke. The grain size of the carbon, coal, or coke is preferably as small as possible, most advantageously below 200 microns ($\mu$).

The present method results in better protection of the nozzles and of the converter (refining vessel) bottom against chemical and thermal wear.

Additional protection against local overheating and resulting wear of the nozzles and of the, e.g. refractory, lining of the refining vessel is effected in a further embodiment of the invention whereby fine ore, e.g. that having a particle size range from finest to about 1 mm, is added to the oxygen and/or to the carrier gas. The addition of fine ore also reduces metal evaporation which, for iron, leads to development of undesirable brown smoke and loss of iron dust. The weight ratio of added fine ore to added carbon is preferably adjusted to a value of less than 5. The exact setting of the ratio below the noted limit depends entirely on the quantity of ore introduced and the dimensions of the nozzle employed. These dimensions increase with the seize of the vessel and with the distance between nozzle and bath surface.

The method is useful in known oxygen blowing processes wherein oxygen required for refining is partially blown into the metal bath with an oxygen-blowing lance. In such case, the amount of oxygen which is blown in below the bath surface is approximately between 0.6 and 1.3, and preferably about 1, $Nm^3$ per kg of introduced carbon.

The invention provides readily available means for controlling and regulating metallurgical process parameters and sequences. Thus, e.g., the bath temperature is regulated during refining by altering the amounts and/or ratios of the streams of oxygen, fine lime (e.g. that having a particle size range from finest to about 3 mm), carbon and fine ore employed during refining. Lifting the stream of finely divided carbonaceous material by 1 kg carbon per ton of metal and per minute effects the temperature of the metal to raise by 8° to 10°C per minute, that is valid up to the value 1 of the ratio carbon/oxygen. If the ratio carbon/oxygen exceeds this value, the concentration of carbon in the metal will raise. Lifting the distribution of ore by 1 kg ore per ton of metal and per minute the raising of temperature during refining is lowered by 8° to 10°C per minute.

The nature, character, or composition of any slag is similarly controlled.

Altering or correcting the bath temperature at the end of the blowing process is readily effected. When the bath temperature is too low, e.g. below 1580°C for molten steel a heavy stream of carbon, e.g. one containing about 1 kg of carbon per 1 $Nm^3$ of oxygen introduced into the melt, is temporarily blown into the molten metal, contrary to known processes, so that the temperature is raised quickly without additional iron losses through the formation of slag. When the metal bath temperature is too high, e.g. above about 1620°C, at the end of the refining process, the addition of fine ore (as coolant) below the surface level of the metal bath results in a distinct advantage over known processes, since this coolant is always completely dissolved in the metal and better temperature control is thus attained.

The economy of the method is immediately apparent. By simply increasing, e.g. by 50 kg carbon (C) per metric ton (t) of metal, the quantity of the stream of inexpensive carbonaceous material, and thus raising the temperature of the melt, the amount of scrap employed per ton of metal can be substantially increased, e.g. from about 260 to about 460 kg. The same rationale likewise applies to other coolants, such as iron ore and sponge iron. For this reason the method is extremely flexible with respect to materials that can be employed, and the composition of the metallic substance used is readily adaptable to the most favorable conditions and raw material prices.

The heat yield results from the difference in reaction heat produced during combustion of C to CO and the removal of heat in the waste gas, as shown in the following computation:

| | |
|---|---|
| Reaction heat during combustion of C to CO | 2,469 Kcal/kg C |
| Heat in 1.865 $Nm^3$ CO at 1600°C produced in the combustion of 1 kg C, plus approximately 15 l/kg C transporting gas | 1,060 Kcal/kg C |
| Heat yield in the bath | 1,409 Kcal/kg C |

This shows that, with a heat content of 330 Kcal/kg of scrap, about 4.3 kg of scrap can be additionally melted at a temperature of 1600°C when 1 kg of C is added to the metal melt. The real heat yield per kg of C is even somewhat higher since the bath temperature during the refining process actually rises from about 1200°C to more than 1600°C. The removed heat thus initially lies in the region of around 720 Kcal/kg of C and increases during refining to the level of 1060 Kcal/kg of C used in the computation. In this example the base material is pure carbon, which is seldom used in practice. The true heat yield depends upon the C content and the presence of heat-consuming gangue particles. The computation further shows that it is favorable from a heat engineering point of view to operate in a low temperature range, e.g. from about 1400° to 1550°C in refining pig iron, during as large a portion of the blowing process as possible. This is facilitated by the temperature control provided by the present invention.

Even when, e.g., iron ore is being refined, finely divided ore other than iron ore is effectively blown into the melt, when such other ore contains an alloying agent. Ferro alloys are e.g. thus prepared, or alloyed steel, and expensive alloying agents can be saved.

Known refining vessels are useful in practicing the present invention. The oxygen and finely divided carbon are preferably blown in at the lowest point or along the bottom of the refining vessel.

The number of nozzles depends on the size of the refining vessel, which may vary, e.g., from about 1 to about 30. It is advantageous to blow a strong oxygen stream into the melt through several nozzles. Such a stream varies, e.g., from 2 to 7 $Nm^3$ per min. and t of pig iron melt in the refining vessel and is transmitted into melt in the refining vessel under a pressure of from 9 to 31 $kp/cm^2$. An additionally introduced stream of finely divided carbon is provided to control conditions as desired.

The method is useful for producing steel from pig iron; it is also useful for other oxidizing refining processes, particularly for the production of copper, nickel and ferronickel where oxidic slag is formed upon introducing oxygen into melt of metal ore in a refining vessel or furnace; the stream of carbon which envelops the stream of oxygen also protects the furnace lining against chemical and thermal attack.

The nature of the method and of illustrative apparatus for practicing the same is further appreciated by reference to the accompanying FIGURE of drawing wherein a tiltable refining vessel or furnace 1 is equipped with a dust removing system 3 through an extraction hood 2 which closely contacts the opening of the refining vessel. The refining vessel 1 has at its under-side a multiple-jacket nozzle 4 through which is introduced (a) highly concentrated CO gas together with carbon dust and possibly fine ore via line 5 and (b) oxygen (as the refining gas), possibly together with lime dust, through line 6 which is connected to a pressure vessel 9 wherein refining gas is maintained, e.g., at a pressure within the range of from 19 to 39 $kp/cm^2$. Line 5 is connected with discharge devices 7' and 8' of a carbon dust vessel 7 and of a fine ore vessel 8, respectively. In the same manner, line 6 (which is connected with an oxygen pressure vessel 9) opens into discharge devices 10' and 11' from a lime vessel 10 and a further fine ore vessel 11, respectively.

In order to charge refining vessel 1 with, e.g., molten pig iron, the vessel is brought into the charging position by a slight tilt. After charging, the refining vessel 1 is righted again and quick acting gate valves 12 and 13 in lines 5 and 6 are opened simultaneously with the discharge device 7'. Predetermined quantities of oxygen and carbon dust (in a stream of CO gas) now flow into the pig iron already in the refining vessel. by opening one or any combination of discharge devices 10', 8' and 11', any desired quantities and/or proportions of lime and ore are additionally introduced into the pig iron melt.

Vessels 7 and 8 are replenished with carrier gas via a line 17, and vessels 10 and 11 are replenished with refining gas via a line 18.

The waste gas produced in refining vessel 1 during the refining process is sucked by means of a suction blower 14 into the cooling and dust removing system 3 and is there cooled and cleansed. The first waste gas obtained at the beginning of the refining process is initially used to rinse or purge waste gas line 15 until it is free from air. Then a highly concentrated CO gas flows through the waste gas line 15. A small portion of this waste gas, which contains up to 98% CO, is diverted as required to line 5 for replenishing a pressure store 16 (wherein carrier gas is maintained, e.g., at a pressure within the range of from 11 to 31 kp/cm$^2$) so that sufficient CO gas is always available as conveying gas for the carbon dust in vessel 7 and for the fine ore in vessel 8.

Upon completion of the refining process and sufficient removal of the refining slag, the desired carbon content of the melt is obtained by blowing carbon dust through the bath in a stream of CO while concurrently reducing the supply of oxygen. In order to control accuracy, if desired, oxygen potential measurements are made.

A control and locking device 21, which is connected with alarm instruments 19 and 20, serves to protect the nozzles and the connections to lines 5 and 6. This device 21 issues instructions to the quick acting gate valves 12 and 13 and to further quick acting gate valves 22 and 23 built into inert gas lines 24 and 25 which open into lines 5 and 6. Lines 24 and 25 are connected to an inert gas pressure vessel 26, wherein inert gas is maintained at a pressure, e.g., within the range of from about 21 to 41 kp/cm$^2$. The inert gas is any gas which is chemically inert with respect to each of the employed ingredients under conditions prevailing in the system, e.g. argon or nitrogen.

The alarm instruments are each set for an upper and an additional lower limit of a measured pressure value. If the pressure in the nozzles or in the lines connected thereto exceeds or falls below one of the limit values, e.g. 36 kp/cm$^2$ or 1.2 kp/cm$^2$, the respective alarm instrument 19 or 20 actuates device 21 so that quick acting gate valves 22 and 23 open automatically and quick acting gate valves 12 and 13 close immediately thereafter. In this way, a stream of inert gas which is at a higher pressure, e.g. by 3 kp/cm$^2$, than the oxygen flows through the nozzle or the lines when there is clogging or leaking in the nozzle or the lines so that an explosion or destruction of the nozzles is prevented. When a plurality of nozzles, each of which has a plurality of openings, is employed, it is possible with the aid of such a safety device to complete refining of a melt in spite of malfunctions.

For those embodiments wherein the alarm instruments monitor flow values in addition to pressure values, the amount of throughput, speed and direction are applicable parameters. The extraction hood used is conventional as known for steel refining vessels especially those having a device to prevent air from penetrating the gas cleaning system.

An exemplary embodiment of the present invention follows. This example is presented solely for the purpose of illustration and in no way limits the nature or scope of the invention.

A three-ton heat of steel was produced in a pilot converter by the process according to the invention in the apparatus showing in the drawing. For this purpose, 1.9 tons of hot metal were charged at a temperature of about 1200°C. The composition of the hot metal was as follows: 4.1 % carbon, 0.6 % silicon, 0.7 % manganese, 0.16 % phosphorus and 0.04 % sulphur. Subsequently, heavy scrap was charged in an amount of 0.6 tons. During this time the nozzle 4 arranged eccentrically in the bottom of the refining vessel, which was a converter 1 was not covered by metal. This nozzle 4 was designed to permit oxygen to be introduced through its centre and pulverized carbonaceous material carried in a stream of carbon monoxide through an annular nozzle disposed concentrically around the central nozzle, the carbonaceous material and the carrier gas thus forming an envelope around the stream of oxygen. For initiating the blow, argon at a pressure of 3.5 atm (kg/cm$^2$) was blown through the nozzles during the tilting up of the converter 1. After the converter had reached its upright position, the discharge device 7' of vessel 7 was opened permitting the carbonaceous material, which was pulverized brown coal coke of a corn grain size below 200 $\mu$ and had a content of carbon of 0.8 % per weight, carried in a stream of CO gas to be passed through the nozzle 4 via the vessel 7, which was constructed as a conventional pressure-type feeder. Upstream of the nozzle 4 the pressure was about 4 atm. Subsequently, the oxygen valve was opened and the inert-gas valves were closed. Nitrogen was used as inert gas. The pressure upstream of the oxygen nozzle of nozzle 4 was about 28 atm. Immediately following the opening of the oxygen valve, fine lime with a maximum particle size of 1 mm was fed by a vessel 10 also constructed as a conventional pressure-type feeder into the oxygen stream in the line 6. A total of 60 kg of lime was blown into the bath during the initial 14 minutes of the blow. Another 30 kg of lime were introduced with the stream of oxygen at a uniform rate during the last 14 minutes of the blow.

The inflow of pulverized brown coal coke amounted to about 2.5 kg/min. during the initial five minutes of the blow. During that time the flow rate of carrier gas was 30 l/min. Subsequently, the carrier gas flow rate was increased to 60 l/min. and the inflow of brown coal coke to 5 kg per minute, during which time the pressure in the line 5 rose to about 8.2 atm. After 10 minutes, continuous charging of fine scrap into the mouth of the converter 1 was started. During this time the input of brown coal coke was raised to 11 kg per minute, the pressure upstream of the nozzle 4 increasing to about 18 atm. Blowing proceeded in this way for about 13 minutes, after which 750 kg of fine scrap had been charged. In order to adjust the bath to the desired tapping temperature of 1600°C, the injection of brown coal coke through the annular nozzle 4 was continued at a rate of about 2.5 kg per minute for a period of 5 minutes, while no further scrap was added. The rate of oxygen input remained constant during the entire blow. After refining had proceeded in the manner described for a period of 28 minutes, the argon supply valves were opened permitting argon to flow through the orifices for oxygen and carbonaceous material in the nozzle 4 after the discharge device 7' for pulverized brown coal coke in the carrier gas stream and the valve for oxygen had been closed. Purging with argon took about 30 seconds. At the end of this time, the converter 1 was tilted down for pouring. The steel showed the following as-tapped composition: 0.08 % carbon, 0.018 % phosphorus, 0.16 % manganese, 0.02 % sulphur.

It will be understood that the above description of the present invention is susceptible to various modifications, changes and adaptations and the same are intended to be comprehended within the meaning and range of equivalents of the appended claims.

We claim:

1. A process for refining a metal comprising introducing a stream of oxygen and particulate lime into a molten bath of the metal at a position below the surface thereof, introducing a stream of gas other than oxygen into and below the surface of the molten bath at about the same position in said bath as the position at which the stream of oxygen and particulate lime is introduced into said bath, the gas other than oxygen being a carrier gas which does not react with carbon, and introducing solid carbon or carbonaceous particles into the molten bath at a rate of at least 50 kg carbon content per metric ton of metal by introducing said particles into the carrier gas at a point outside the molten bath so that the carrier gas transmits said particles to the bath from a point outside the bath.

2. A process according to claim 1 wherein the metal is pig iron.

3. A process according to claim 1 which comprises concurrently passing said streams into the molten bath at or near the bottom thereof.

4. A process according to claim 1 wherein the stream of oxygen is enveloped by the stream of carrier gas.

5. A process according to claim 4 wherein the stream of oxygen contains finely divided ore.

6. A process according to claim 4 wherein the stream of carrier gas contains finely divided ore.

7. A process according to claim 4 wherein at least one of the oxygen and carrier gas streams contains finely divided ore at some time during the metal refining process and the weight ratio of total ore to total carbon passed into the molten bath is less than 5.

8. A process according to claim 4 which comprises passing the gas streams into the molten bath at or near the bottom thereof and wherein the carbon or carbonaceous particles are in the form of carbon dust.

9. A process according to claim 8 wherein the metal is pig iron and the stream of carrier gas contains from 3 to 20 liters of carrier gas per kilogram of carbon dust.

10. A process according to claim 3 wherein the carrier gas is carbon monoxide.

11. A process according to claim 10 wherein the carrier gas is obtained as a byproduct of the metal refining process.

12. A process according to claim 1 wherein temperature control of the molten bath is regulated by varying the make-up and intensity of the oxygen and of the carrier gas streams.

13. A process according to claim 2 which comprises varying the amount of carbon in the carrier gas stream at the end of the refining process to adjust the carbon content of the molten bath to that desired.

14. The process according to claim 1 wherein the carrier gas is an inert gas or carbon monoxide.

15. A process for refining a metal comprising:

introducing a stream of oxygen and particulate lime into a molten bath of the metal at a position below the surface thereof;

introducing a stream of gas other than oxygen into and below the surface of the molten bath at about the same position in said bath as the position at which the stream of oxygen and particulate lime is passed into said bath, the gas other than oxygen being a carrier gas which does not react with carbon, introducing solid carbon or carbonaceous particles into the molten bath by introducing said particles into the carrier gas at a point outside the molten bath so that the carrier gas transmits said particles to the bath from a point outside the bath, said particles reaching in the bath to form carbon monoxide and yield heat to the bath, to enable introduction of scrap into the bath based on the heat yield to the bath.

* * * * *